US006270385B1

(12) United States Patent
Varney et al.

(10) Patent No.: US 6,270,385 B1
(45) Date of Patent: Aug. 7, 2001

(54) PUMP JET ROTOR HOUSING MODIFICATION FOR NOISE SIGNATURE SPECTRAL CONTROL

(75) Inventors: A. Michael Varney, Sewall's Point; John D. Martino, Longwood, both of FL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/391,286

(22) Filed: Sep. 7, 1999

(51) Int. Cl.[7] ..... B63H 11/103
(52) U.S. Cl. ..... 440/38; 440/47
(58) Field of Search ..... 440/38, 47, 67, 440/70, 71; 60/221, 222

(56) References Cited

U.S. PATENT DOCUMENTS

| | | | | |
|---|---|---|---|---|
| 3,034,467 | * | 5/1962 | Pestronk | 440/38 |
| 3,346,174 | | 10/1967 | Lievens et al. | 230/120 |
| 3,398,932 | | 8/1968 | Koeller et al. | 253/117 |
| 3,821,999 | | 7/1974 | Guess et al. | 181/33 H |
| 4,453,887 | | 6/1984 | Schucker | 415/119 |
| 4,637,801 | * | 1/1987 | Schultz | 440/67 |
| 4,692,091 | | 9/1987 | Ritenour | 415/119 |
| 4,720,239 | | 1/1988 | Owczarek | 415/181 |
| 4,828,175 | | 5/1989 | Heufler et al. | 239/14.2 |
| 5,060,471 | | 10/1991 | Torkelson | 60/262 |
| 5,099,566 | | 3/1992 | Barrett | 29/451 |
| 5,160,248 | | 11/1992 | Clarke | 415/9 |
| 5,215,433 | | 6/1993 | Weiland et al. | 415/119 |
| 5,256,031 | | 10/1993 | Bothien et al. | 415/1 |

* cited by examiner

*Primary Examiner*—Ed Swinehart
(74) *Attorney, Agent, or Firm*—Dennis M. Flaherty

(57) ABSTRACT

A pump jet having a perforated wear liner inside the rotor housing for altering the spectrum of noise produced by the pump jet. The perforated wear liner is inserted in a circumferential recess formed on the inner surface of the rotor housing and surrounds the rotor tip region. The throughholes or perforations are preferably constant in size and regularly spaced. The perforated wear liner acts as a Helmholtz resonator liner which alters the spectrum of noise emitted from the pump jet during operation. Proper selection of the size, number and spacing of the holes permits the designer to control the specific noise spectrum range that is emitted from the front and rear lobes of the pump jet, thereby altering the hydrodynamic noise field.

18 Claims, 6 Drawing Sheets

PUMP JET ROTOR HOUSING MODIFICATION FOR NOISE SIGNATURE SPECTRAL CONTROL

FIELD OF THE INVENTION

This invention generally relates to pump jets used with outboard motors or in inboard/outboard or stern drive units of boats and other vehicles. In particular, the invention relates to means and methods for reducing noise produced by an operating pump jet.

BACKGROUND OF THE INVENTION

In one type of conventional outboard motor, a propeller is driven by a powerhead to propel a boat through water. Most large outboard motors of this type inject the exhaust gas stream under water in order to reduce engine noise.

In a typical configuration shown in FIG. 1, the gas exhausted from the powerhead 10 flows downwardly through an exhaust channel 12 and exits the motor rearwardly through the propeller 14. This type of motor is referred to as an exhaust-through-hub (ETH) motor.

A boat powered by an outboard motor equipped with a conventional open propellor generates a unique noise signature which is characterized by a three-dimensional noise field similar in shape to an ice cream cone lying on its side. The size of the noise field is determined by the propeller size, the number of propellor blades, the rotational speed of the engine. etc.

For many applications, the capability to restrict the size of the emitted noise field, as well as change its spectral intensity over the field of interest (e.g., audible near-field alteration), is desirable. A shroud or propeller guard can be used to achieve part of the noise field reduction, but installation of a shroud or propeller guard is accompanied by a loss in performance of the propulsion system.

Another type of conventional outboard motor has an axial-flow pump jet system driven by the powerhead. In a pump jet system, an impeller or rotor is mounted (e.g., spline fitted) directly on the propeller output shaft in place of the propeller. There are typically no modifications to the drive train, cooling or sealing components. A ducted housing surrounds the rotor. Such a system has the advantages of reducing hazards to swimmers in the vicinity of the motor, protecting the rotating elements from interference with and damage by foreign objects in the water, and improving the efficiency and performance of the propulsion system. Another benefit inherent with the pump jet is a directed jet of water that results in greater steering response. More pertinent to the present invention, the pump jet propulsor, with its high-efficiency shrouded design, alters the radial noise field and provides an opportunity to also alter the noise spectrum.

SUMMARY OF THE INVENTION

The present invention has application in pump jets of the type having a rotor assembly surrounded by a housing. In one conventional type of jet pump apparatus, the housing comprises a rotor housing connected to a stator housing, the former surrounding the rotor and the latter being downstream of the rotor. The rotor is driven by the powerhead via a drive train. Rotation of the rotor impels ambient water from the housing inlet to the housing outlet.

Due to manufacturing tolerances, during rotation the rotor can wobble on the propeller shaft, causing the tips of the rotor blades to contact the opposing surrounding surface, thereby causing that surface to wear. If the inner circumferential surface of the rotor housing were placed in close surrounding relationship to the rotor, without an intervening member, then that rotor housing surface would experience wear. If that wear were allowed to continue indefinitely, replacement of the worn rotor housing could become necessary.

A conventional solution to this problem is to make a circumferential recess in the rotor housing at a position opposing the rotor blade tips and then to install a replaceable, i.e., sacrificial, circular cylindrical wear liner in that recess. Consequently, wear caused by the wobbling rotor will occur on the inner circumferential surface of the wear liner. When the damage to the wear liner reaches an unacceptable level, the wear liner can then be replaced without the necessity of replacing the rotor housing.

In accordance with the present invention the wear liner inside the rotor housing is modified in order to alter the spectrum of noise produced by the pump jet. In the preferred embodiment, a replaceable wear liner in the form of a perforated sleeve is inserted in a circumferential recess formed on the inner surface of the rotor housing. The perforated wear liner surrounds the rotor tip region and has a multiplicity of small, preferably circular throughholes.

In accordance with the preferred embodiment of the invention, the throughholes or perforations are constant in size and regularly spaced. The holes may be drilled, punched or otherwise formed. Preferably, the perforated wear liner is a circular cylindrical continuous ring or rolled strip. In surrounding relationship to the tips of the rotor blades, the perforated wear liner acts as a Helmholtz resonator liner which alters the spectrum of noise emitted from the pump jet during operation. Proper selection of the size, number and spacing of the holes permits the designer to control the specific noise spectrum range that is emitted from the front and rear lobes of the pump jet, thereby altering the hydrodynamic noise field.

DETAILED DESCRIPTION OF THE PREFERRED EMBODIMENTS

Figure 1:
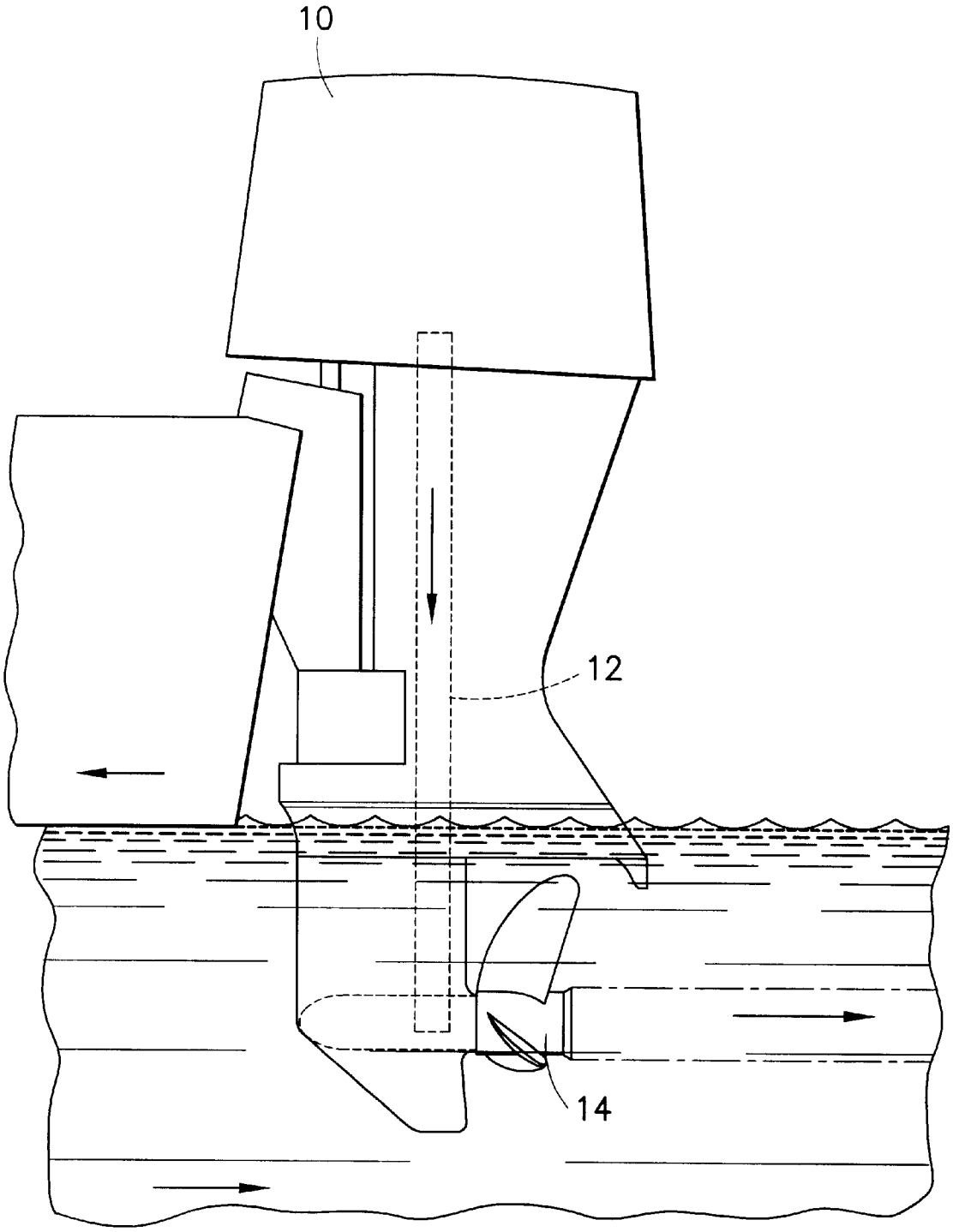
FIG. 1 PRIOR ART
FIG. 1 is a schematic view of a prior art ETH motor with a propeller.
Figure 2:
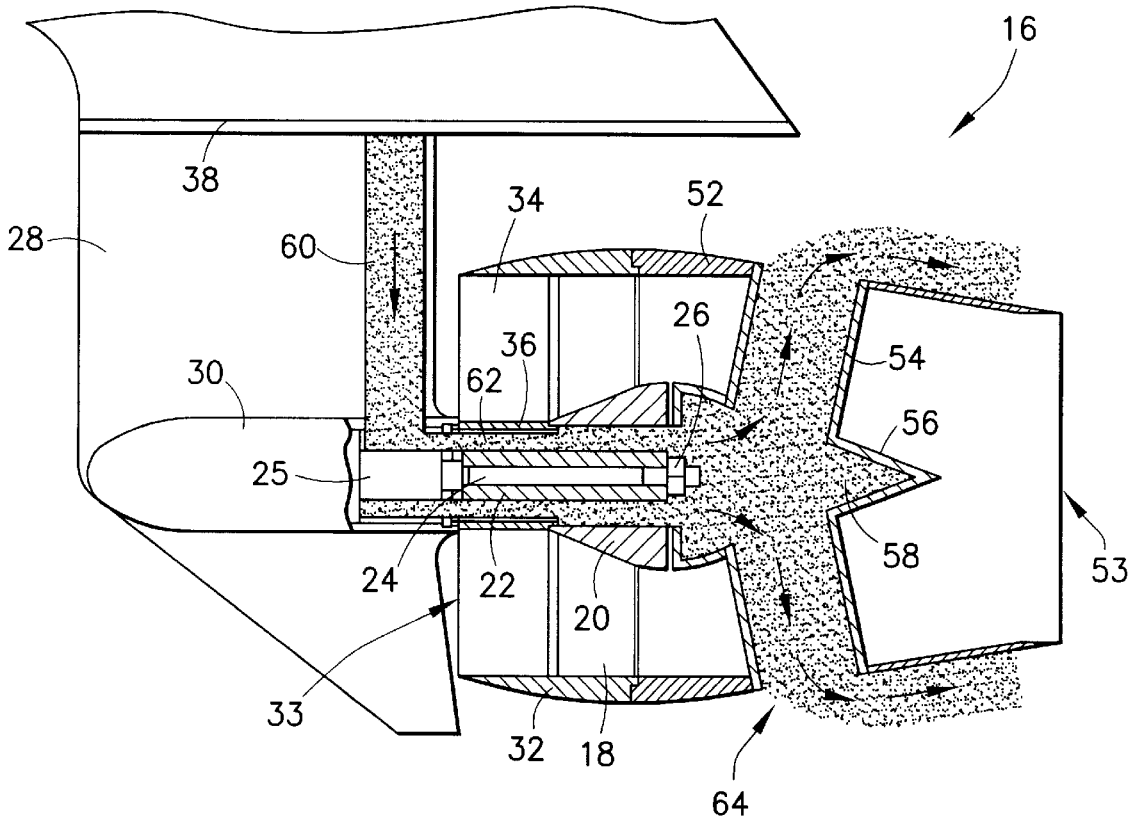
FIG.2 PRIOR ART
FIG. 2 is a partial sectional view of a conventional ETV pump jet having exhaust streams discharged through at least two stator vanes.

An outboard motor having a pump jet 16 of the ETV type is shown in FIG. 2. The pump jet includes a rotor comprising a plurality of blades 18 extending radially outward from an outer rotor hub 20. The outer rotor hub 20 is securely mounted on an inner rotor hub 22. The rotor and inner rotor hub are assembled prior to installation. During pump jet installation, this one-piece rotor assembly is inserted onto one end of a propeller shaft 24 and secured to the shaft by a nut 26. The other end of the propeller shaft is rotatably mounted in a bearing (not shown) which is housed in propeller shaft bearing housing 25. Inner rotor hub 22 is connected to outer rotor hub 20 by means of radial struts, which are not visible in the partially sectional view of FIG. 2.

In conventional fashion, the powerhead 10 drives the propeller shaft 24 to rotate via a drive shaft and gears, neither of which are shown in FIG. 2. The drive shaft extends inside the lower housing unit 28, while the gears are arranged inside the gear case 30. Rotation of the propeller shaft in turn causes the rotor assembly to rotate. During rotation in forward gear, the angled blades 18 of the rotor impel water axially rearward to produce a forward thrust. In reverse gear, a reverse thrust is produced.

The rotor assembly is surrounded by a non-rotating rotor housing 32. The rotor housing 32 is part of a one-piece rotor housing assembly, which also comprises a plurality of inlet vanes 34 and an inlet vane hub 36. Each inlet vane 34 is joined at one end to the inlet vane hub 36 and at the other end to the rotor housing 32. The inlet vanes direct water flow into the blades 18 of the rotor. The inlet vanes also block debris, sea creatures or human limbs from contacting the rotating blades of the rotor.

Figure 3:
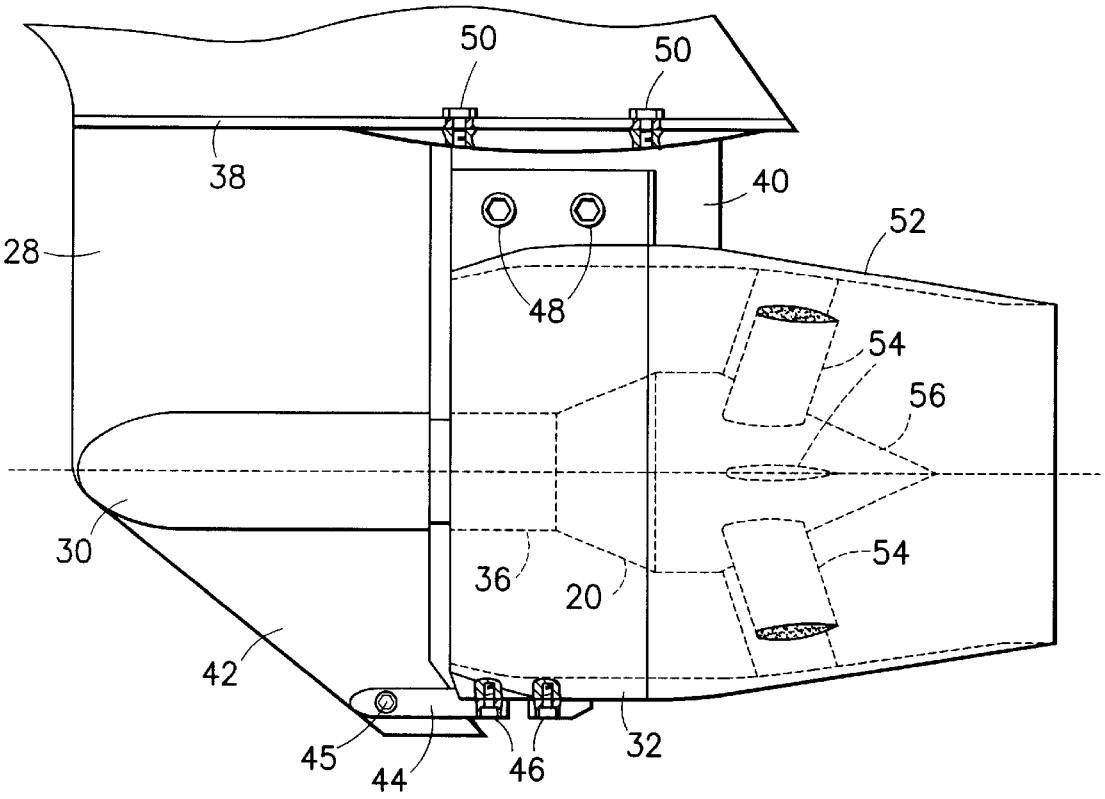
FIG.3 PRIOR ART
FIG. 3 is a side elevational view showing the manner of attachment of the pump jet of FIG. 2 to an outboard motor.

During pump jet installation, the rotor housing assembly is installed prior to installation of the rotor assembly. The inlet vane hub 36 is inserted into the downstream end of the gear case 30. Referring to FIG. 3, the rotor housing assembly is joined to an anti-cavitation plate 38 by means of an upper bracket 40 and is joined to skeg 42 by means of a clamp 44. Screw 45 squeezes the clamp 44 onto the skeg 42. Screws 46 secure the clamp 44 to the rotor housing 32. Screws 48 and bolts 50 attach the upper bracket 40 to the anti-cavitation plate 38.

Referring again to FIG. 2, the rotor housing 32, which has an inlet 33 for the intake of water, forms the upstream portion of the shroud which fully encloses the pump jet. The rearward portion of the shroud comprises a stator housing 52 which has an outlet 53 for the water propelled rearward by the rotor blades 18. The stator housing 52 has an upstream edge which form fits with the downstream edge of the rotor housing 32. Installation of a pump jet involves three steps: (1) attach the rotor housing to the anti-cavitation plate and skeg; (2) install the rotor on the propellor shaft; and (3) attach the stator housing to the rotor housing by means of screws (not shown in FIG. 2). The stator housing 52 has a generally conical portion which decreases in internal diameter in the downstream direction. The minimum internal diameter of stator housing 52 is preferably located at the outlet 53.

The stator housing 52 is part of a one-piece stator housing assembly, which also comprises a plurality of stator vanes 54 and a stator hub 56. Each stator vane 54 is joined at one end to the stator hub 56 and at the other end to the stator housing 52. The stator vanes convert rotational energy imparted to the water flow by the rotor blades into axial flow energy at the outlet of the stator housing 52. One or more of the stator vanes 54 is hollow. Similarly, an internal cavity in the stator hub 56 forms a plenum cavity 58, which is in flow communication with each hollow stator vane. Nut 26 extends into plenum cavity 58 in stator hub 56.

The exhaust gas from the powerhead 10 flows downwardly through an exhaust channel 60. The lower end of the exhaust channel 60 is in flow communication with a hub exhaust channel 62 which channels the exhaust stream rearward through the hub. The hub exhaust channel 62 is an annular space, which is bounded internally by the propeller shaft bearing housing 25 and the inner rotor hub 22, and externally by the wall of the gear case 30, the inlet vane hub 36 and the outer rotor hub 20. The exhaust stream flows from the hub exhaust channel 62 to the plenum cavity 58 in stator hub 56, and then into the hollow stator vanes 54 which communicate with the plenum cavity. Preferably at least a portion of the stator hub 56 is conical in shape. The exhaust stream in each hollow stator vane flows the length of the stator vane and discharges from a respective exhaust port 64 into the water stream surrounding the stator housing 52.

Figure 4:
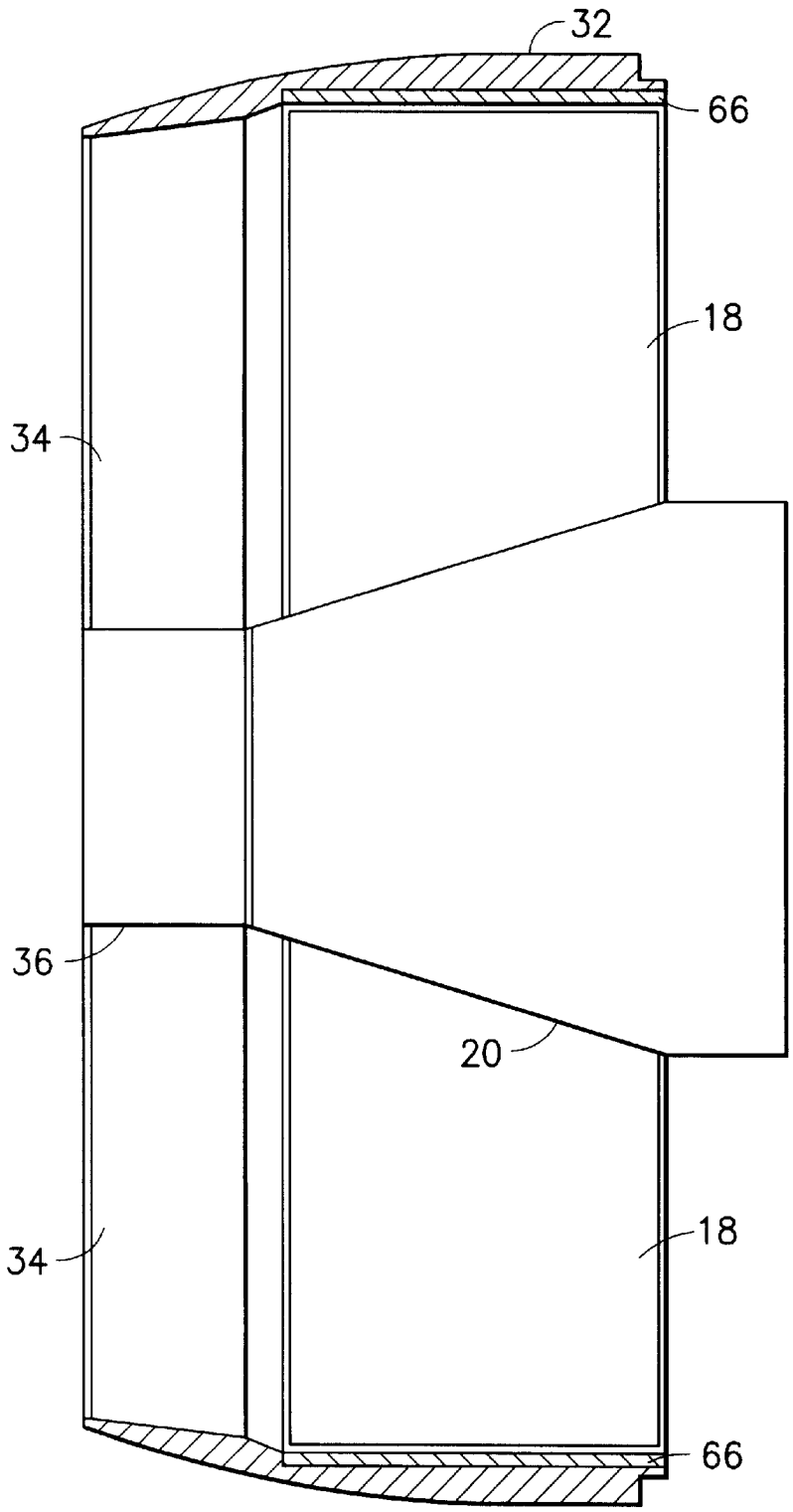
FIG.4 PRIOR ART
FIG. 4 is a partial sectional view of portions of a pump jet of the type shown in FIG. 2, having a replaceable wear liner in an inner circumferential groove formed in the rotor housing.

As shown in FIG. 4, in one conventional pump jet apparatus the rotor housing 32 surrounds the rotor blades 18 and is separated therefrom by a wear liner 66. The gap separating the wear liner 66 and the tips of the rotor blades is exaggerated in the drawing for the sake of clarity. The typical wear liner is a circular cylindrical ring or sleeve seated in a circumferential recess machined in the inner circumferential surface of rotor housing 32. The inner diameter of the wear liner 66 is only slightly greater than the diameter of the circle defined by the blade tips during rotor rotation. Due to manufacturing tolerances, during rotation the rotor can wobble on the propeller shaft 24 (see FIG. 2). As the rotor wobbles on the propellor shaft, the tips of the rotor blades 18 (see FIG. 4) can contact the inner circumferential surface of the wear liner 66, causing that surface to wear. When the damage to the wear liner reaches an unacceptable level, the wear liner can be replaced without the necessity of replacing the rotor housing.

Figure 5:
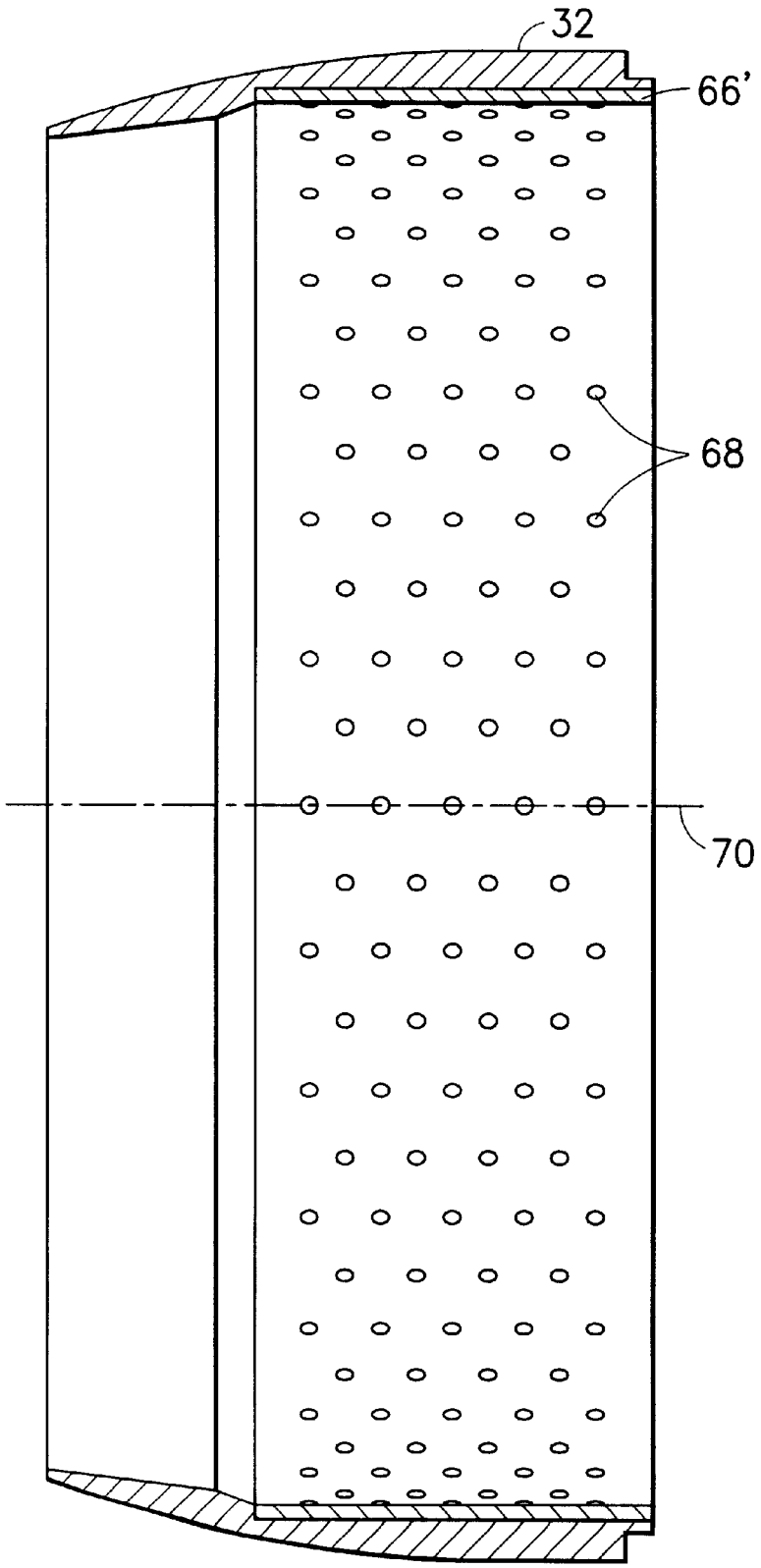
FIG. 5 is a partial sectional view of a rotor housing and wear liner arrangement in accordance with the preferred embodiment of the invention.
Figure 6:
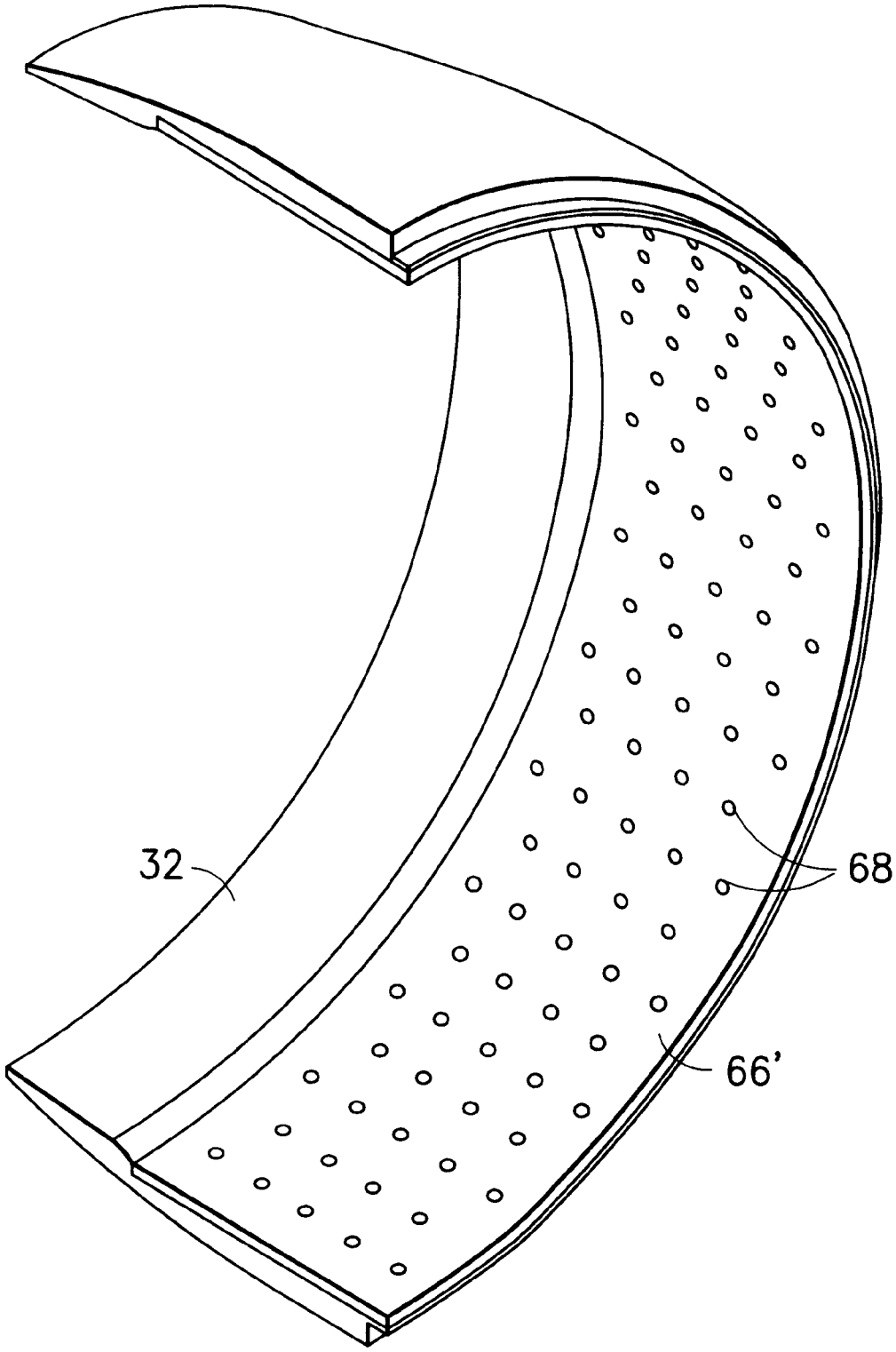
FIG. 6 is an isometric view of the rotor housing and wear liner arrangement depicted in FIG. 5.

In accordance with the preferred embodiment of the invention shown in FIGS. 5 and 6, a wear liner 66' is provided with a multiplicity of small, preferably circular throughholes or perforations 68 which are constant in size and regularly spaced. The perforations 68 are distributed around the circumference of the wear liner and across the length of the wear liner, each perforation having a central axis coaxial with a respective radial line intersecting the central axis 70 of the rotor assembly. The holes may be drilled, punched or otherwise formed. The perforated wear liner 66' acts as a Helmholtz resonator liner which alters the spectrum of noise emitted from the pump jet during operation. Proper selection of the size, number and spacing of the holes permits the designer to control the specific noise spectrum range that is emitted from the front and rear lobes of the pump jet, thereby altering the hydrodynamic noise field.

In accordance with one aspect of the invention, the hydrodynamic noise field of a pump jet apparatus can be altered by substituting a perforated wear liner for an unperforated wear liner, i.e., by retrofitting the pump jet apparatus with a perforated liner. This is easily accomplished by removing the stator housing 52 from the rotor housing 32 (see FIG. 2) by unscrewing the set of screws which couple the housings; removing the unperforated wear liner 66 by sliding it rearwardly out of the recess in the rotor housing (see FIG. 4); and then inserting a perforated wear liner 66' by sliding it forwardly into the recess in the rotor housing (see FIG. 5). Alternatively, the unperforated wear liner can be removed, perforated, e.g., by machining, and then reinstalled in the rotor housing.

In accordance with a further aspect of the invention, interchangeable perforated wear liners corresponding to different noise spectrum ranges can be provided. The different noise spectrum ranges can be achieved by varying one or more of the size, number and spacing of the perforations for different wear liners. A wear liner having a first effect on the noise spectrum range can be replaced by a different wear liner having a second effect on the noise spectrum range of the pump jet.

The invention has application in both outboard drive units and inboard/outboard or stern drive units for watercraft and other vehicles. A propulsor of a stern drive unit is typically mounted to the stern or transom of a boat hull via a transom mount assembly or bracket. The shaft on which the pump jet rotor is mounted is driven to rotate by an engine mounted inside the boat via conventional gear assemblies mounted outside the boat.

While the invention has been described with reference to preferred embodiments, it will be understood by those skilled in the art that various changes may be made and equivalents may be substituted for elements thereof without departing from the scope of the invention. In particular, it is not essential to practice of the invention that all of the perforations be the same size. For example, instead of providing perforations in the wear liner which are constant in size, two or more sets of perforations can be provided having different respective sizes, the perforations of different sizes, however, preferably being arranged in a regular pattern which is symmetric about the circumference of the wear liner. In addition, the hole spacing in the axial direction can be different than the hole spacing in the circumferential direction. Nor is the invention avoided by arranging the holes in a regular pattern of groups, with holes within a group separated by a first distance and with groups separated by a second distance different than the first distance. Many such variations are possible while still providing the equivalent function, namely, altering the spectrum of noise emitted from the pump jet. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

As used in the claims, the term "marine engine" includes both inboard and outboard motors.

What is claimed is:

1. A pump jet apparatus for a marine engine, comprising:

a rotor assembly mounted on a rotatable shaft, said rotor assembly comprising a rotor hub coupled to said rotatable shaft and a plurality of rotor blades, each rotor blade being connected at one end to said rotor hub;

a rotor housing surrounding said rotor assembly, having an inlet and an outlet, and comprising a circumferential recess surrounding said rotor blades;

a ring-shaped wear liner installed in said circumferential recess and having a multiplicity of holes extending radially therethrough;

a stator housing coupled to said rotor housing and having an inlet and an outlet for water flow, said inlet of said stator housing being in flow communication with said outlet of said rotor housing; and a stator hub positioned rearwardly of said rotor hub and inside said stator housing.

2. The pump jet apparatus as recited in claim 1, wherein said holes are circular in shape.

3. The pump jet apparatus as recited in claim 1, wherein said holes are constant in size.

4. The pump jet apparatus as recited in claim 1, wherein said holes are regularly spaced.

5. A pump jet apparatus for a marine engine, comprising:

a rotor assembly mounted on a rotatable shaft, said rotor assembly comprising a rotor hub coupled to said rotatable shaft and a plurality of rotor blades, each rotor blade being connected at one end to said rotor hub;

a rotor housing surrounding said rotor assembly, having an inlet and an outlet;

a ring installed between said rotor assembly and said rotor housing, said ring comprising means for altering a hydrodynamic noise field of said pump jet apparatus;

a stator housing coupled to said rotor housing and having an inlet and an outlet for water flow, said inlet of said stator housing being in flow communication with said outlet of said rotor housing; and a stator hub positioned rearwardly of said rotor hub and inside said stator housing.

6. The pump jet apparatus as recited in claim 5, wherein said hydrodynamic noise field altering means comprise a multiplicity of openings in an inner circumferential surface of said ring.

7. The pump jet apparatus as recited in claim 6, wherein said openings are circular in shape.

8. The pump jet apparatus as recited in claim 6, wherein said openings are constant in size.

9. The pump jet apparatus as recited in claim 6, wherein said openings are regularly spaced.

10. A pump jet apparatus for a marine engine, comprising:

a rotor assembly mounted on a rotatable shaft, said rotor assembly comprising a rotor hub coupled to said rotatable shaft and a plurality of rotor blades, each rotor blade being connected at one end to said rotor hub; and a housing surrounding said rotor assembly, having an inlet and an outlet for water flow, and comprising means for altering a hydrodynamic noise field of said pump jet apparatus, said hydrodynamic noise field altering means being arranged in surrounding relationship to said rotor assembly and comprising a multiplicity of recesses, each recess comprising a respective opening in an inner circumferential surface of said housing and not penetrating through to an outer circumferential surface of said housing.

11. The pump jet apparatus as recited in claim 10, wherein said housing is an assembly comprising a perforated ring-shaped liner and an unperforated outer shell surrounding said perforated ring-shaped liner.

12. A method for retrofitting a pump jet apparatus, comprising the steps of:

uncoupling a stator housing from a rotor housing;

removing an unperforated wear liner from a recess in said rotor housing;

inserting a perforated wear liner in said recess in said rotor housing; and coupling said stator housing to said rotor housing.

13. A method for retrofitting a pump jet apparatus, comprising the steps of:

uncoupling a stator housing from a rotor housing;

removing an unperforated wear liner from a recess in said rotor housing;

forming a multiplicity of perforations in said wear liner after said removing step;

inserting said perforated wear liner in said recess in said rotor housing; and coupling said stator housing to said rotor housing.

14. An apparatus for propelling a watercraft, comprising:

a rotatable shaft;

a powerhead coupled to said shaft for driving rotation of said shaft;

a rotor assembly mounted on said shaft, said rotor assembly comprising a rotor hub coupled to said rotatable shaft and a plurality of rotor blades, each rotor blade being connected at one end to said rotor hub; and a housing surrounding said rotor assembly, having an inlet and an outlet for water flow, and comprising means for altering a hydrodynamic noise field of said pump jet apparatus during rotation of said shaft, said hydrodynamic noise field altering means being arranged in surrounding relationship to said rotor assembly and comprising a multiplicity of recesses, each recess comprising a respective opening in an inner circumferential surface of said housing and not penetrating through to an outer circumferential surface of said housing.

15. The apparatus as recited in claim 14, wherein said housing is an assembly comprising a perforated ring-shaped liner and an unperforated outer shell surrounding said perforated ring-shaped liner.

16. The apparatus as recited in claim 14, wherein said openings are circular in shape.

17. The apparatus as recited in claim 14, wherein said openings are constant in size.

18. The apparatus as recited in claim 14, wherein said openings are regularly spaced.

* * * * *